United States Patent [19]

Catchpole

[11] Patent Number: 4,526,141

[45] Date of Patent: Jul. 2, 1985

[54] DRIVE ARRANGEMENT FOR INTERNAL COMBUSTION ENGINE

[75] Inventor: Brian G. Catchpole, Burwood, Australia

[73] Assignee: The Commonwealth of Australia, Australian Capital Territory, Australia

[21] Appl. No.: 579,548

[22] Filed: Feb. 13, 1984

[30] Foreign Application Priority Data

Feb. 15, 1983 [AU] Australia ..... PF8041

[51] Int. Cl.[3] ..... F02B 25/08

[52] U.S. Cl. ..... 123/51 BA; 123/56 C; 123/197 AC

[58] Field of Search ..... 123/51 R, 51 A, 51 AA, 123/51 AC, 51 B, 51 BC, 51 BD, 51 BA, 197 R, 197 AC, 197 AB, 56 C; 418/268

[56] References Cited

U.S. PATENT DOCUMENTS

| | | | |
|---|---|---|---|
| 852,033 | 4/1907 | Philippe | 123/56 C |
| 1,487,180 | 3/1924 | Reineke | 123/51 B |
| 1,858,681 | 5/1932 | Olson | 418/268 |
| 1,869,787 | 8/1932 | Trumble | 123/51 B |
| 2,006,498 | 7/1935 | Dasset | 123/197 AC |
| 2,199,625 | 5/1940 | Fiala-Fernbrugg | 123/51 AA |
| 3,559,628 | 2/1971 | Boldery | 123/56 C |
| 4,071,000 | 1/1978 | Herbert | 123/51 BA |
| 4,180,028 | 12/1979 | Richter | 123/45 A |

FOREIGN PATENT DOCUMENTS

| | | | |
|---|---|---|---|
| 45493 | 10/1917 | Sweden | 123/56 C |
| 320839 | 10/1929 | United Kingdom | 123/51 B |

*Primary Examiner*—Craig R. Feinberg

*Attorney, Agent, or Firm*—Stevens, Davis, Miller & Mosher

[57] ABSTRACT

An internal combustion engine including: a cylinder, a combustion chamber in the cylinder, two opposed pistons within the cylinder and relatively movable towards and away from each other. The combustion chamber is defined between the two pistons. Each piston has an inner side defining a movable wall of the combustion chamber and also has an outer side. Two rotary output shafts extend generally transverse to the axial direction of movement of the pistons. The pistons are freely independently movable within the cylinder. An eccentric cam portion is provided on each output shaft so as to be rotatable therewith and each piston has a cam follower portion in the form of a rotary member on the outer side thereof. Each cam follower portion is arranged to bear against the associated eccentric cam portion of the respective output shaft so as to transmit outwardly directed gas forces arising within the combustion chamber and acting on the piston inner sides to the accentric cam portions so as to drive the output shafts.

15 Claims, 3 Drawing Figures

DRIVE ARRANGEMENT FOR INTERNAL COMBUSTION ENGINE

Figure 1:
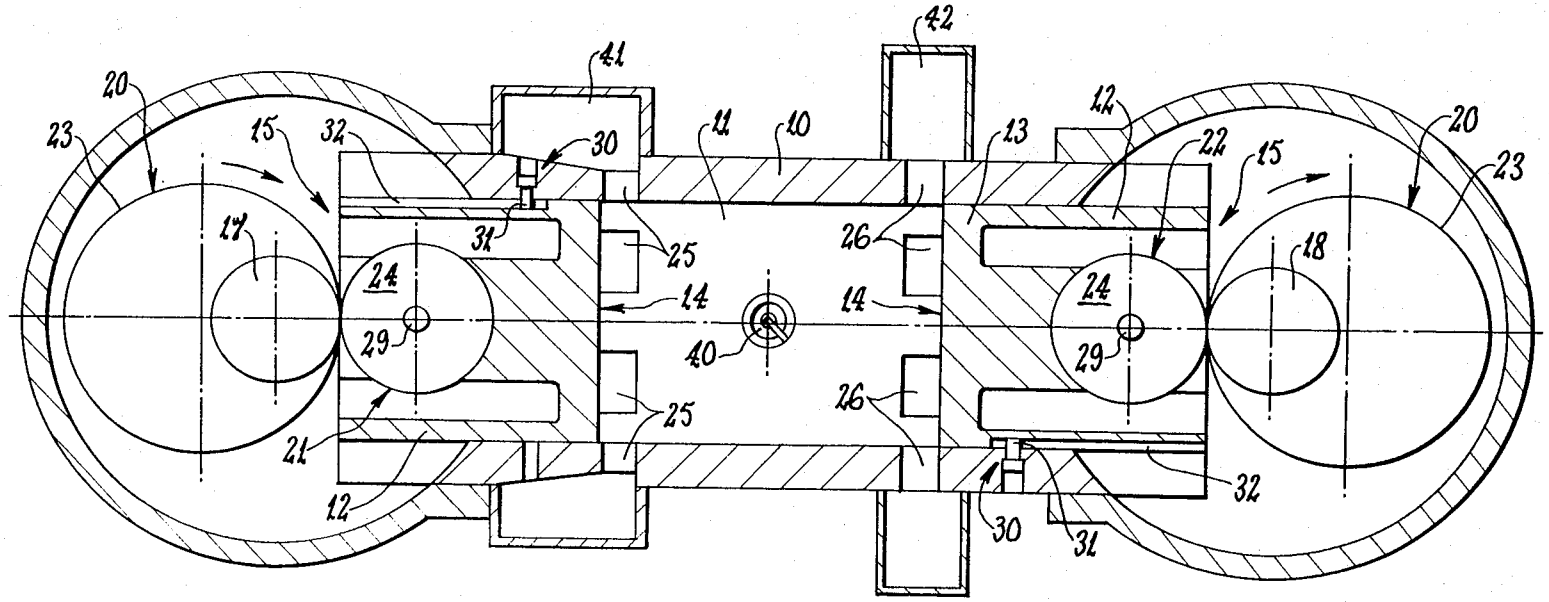

This invention relates to internal combustion engines and particularly to drive arrangements between the pistons and output shafts of internal combustion engines. The invention particularly relates to relatively small lightweight internal combustion engines such as those used in remote controlled small light aircraft such as used for reconnaissance purposes, but the invention is not limited to this particular type of internal combustion engine.

In conventional internal combustion engines there is provided a piston axially movable within a cylinder defining a combustion chamber, an output shaft in the form of a crankshaft and a connecting rod between the piston and the crankshaft. In such reciprocating engines utilising the two stroke cycle, the gas forces on the piston generally act towards the crankshaft. The main forces acting along the axis of the connecting rod during operation are those due to the gas forces on the piston are applied by it to the connecting rod and the inertial forces also applied by the piston to the connecting rod. At all except the very highest speeds the gas forces are larger than the inertial forces so that the connecting rod is in compression.

It is an object of the present invention to provide a different drive transmitting arrangement between a piston and an output shaft of an internal combustion engine enabling ease of manufacture and reduced size and hence weight for an engine of a given swept volume.

According to the present invention there is provided an internal combustion engine including: a cylinder, a combustion chamber in the cylinder, two opposed pistons within the cylinder and relatively movable towards and away from each other, the combustion chamber being defined between the two pistons, each piston having an inner side defining a movable wall of the combustion chamber and also having an outer side, two rotary output shafts extending generally transverse to the axial direction of movement of the pistons, characterised in that said pistons are freely independently movable within the cylinder, an eccentric portion being provided on each output shaft so as to be rotatable therewith, each piston having an eccentric follower portion on the outer side thereof, each eccentric follower portion being arranged to bear against the associated eccentric portion of the respective output shaft so as to transmit outwardly directed gas forces arising within the combustion chamber and acting on the piston inner sides to the eccentric portions so as to drive the output shafts.

Preferably the configurations of the eccentric and eccentric follower portions are such that the gas forces acting on the inner sides of the pistons are sufficient to maintain contact between the eccentric follower portions and the eccentric portions for the major part of the operating cycle of the engine. In particular, preferably the configurations of the eccentric and eccentric follower portions are such that the momenta of the pistons imparted thereto by the eccentric portions during movement of the pistons towards each other are insufficient for the eccentric follower portions to move out of contact with the eccentric portions against the gas forces acting on the inner sides of the pistons when the pistons are at or near their closest relative approach to each other so that the eccentric follower portions remain in contact with the eccentric portions for the entire operating cycle of the engine.

Each eccentric follower portion preferably comprises a rotary member which is rotatably mounted on the outer side of the piston so as to provide a rolling contact between the eccentric follower portion and the eccentric portion. The rotary member may be rotatably mounted by a bearing arrangement including a bearing shaft to which the rotary member is concentrically mounted, the axis of the bearing shaft being generally parallel to the associated output shaft, the bearing shaft having opposite ends rotatably mounted in bearings provided on the outer side of the respective piston.

In order to purge the combustion chamber of burnt products and replace these with a combustible fuel and air mixture the engine preferably includes: an inlet port in the cylinder for admitting a fuel-air mixture to the combustion chamber, and an exhaust port in the cylinder for exhausting combustion products from the combustion chamber, the two pistons being movable towards each other within the cylinder during a compression stroke to compress the fuel charge and being movable away from each other during an expansion stroke upon ignition of the compressed charge, and a feed blower being arranged to force the fuel-air mixture through the inlet port into the combustion chamber under pressure. The feed blower preferably includes: a pumping chamber having internal chamber walls, a driven rotor eccentrically mounted within the pumping chamber, at least one pumping vane having an inner edge pivotally connected to the rotor and an outer edge operable to engage the pumping chamber walls under centrifugal force during rotation of the rotor and to pivotally retract towards the rotor, an intake port for receiving a fluid used in the fuel-air mixture, the intake port being located in the pumping chamber wall at an expansion side thereof where the outer edge of the or each vane moves outwardly away from the rotor under centrifugal force, and an outlet port located in the pumping chamber wall at a compression side thereof where the outer edge of the or each vane retracts inwardly towards the rotor where the chamber side wall approaches the eccentrically mounted rotor, the outlet port being in communication with the inlet port of the cylinder to supply the fluid under pressure to the engine. Preferably the rotor is driven in a direction such that the outer edge of the or each vane trails behind the inner edge thereof so that any fluid back pressure transmitted through the outlet port can be relieved between the vane outer edge and the chamber walls by pivoting of the vane towards the rotor.

Figure 2:
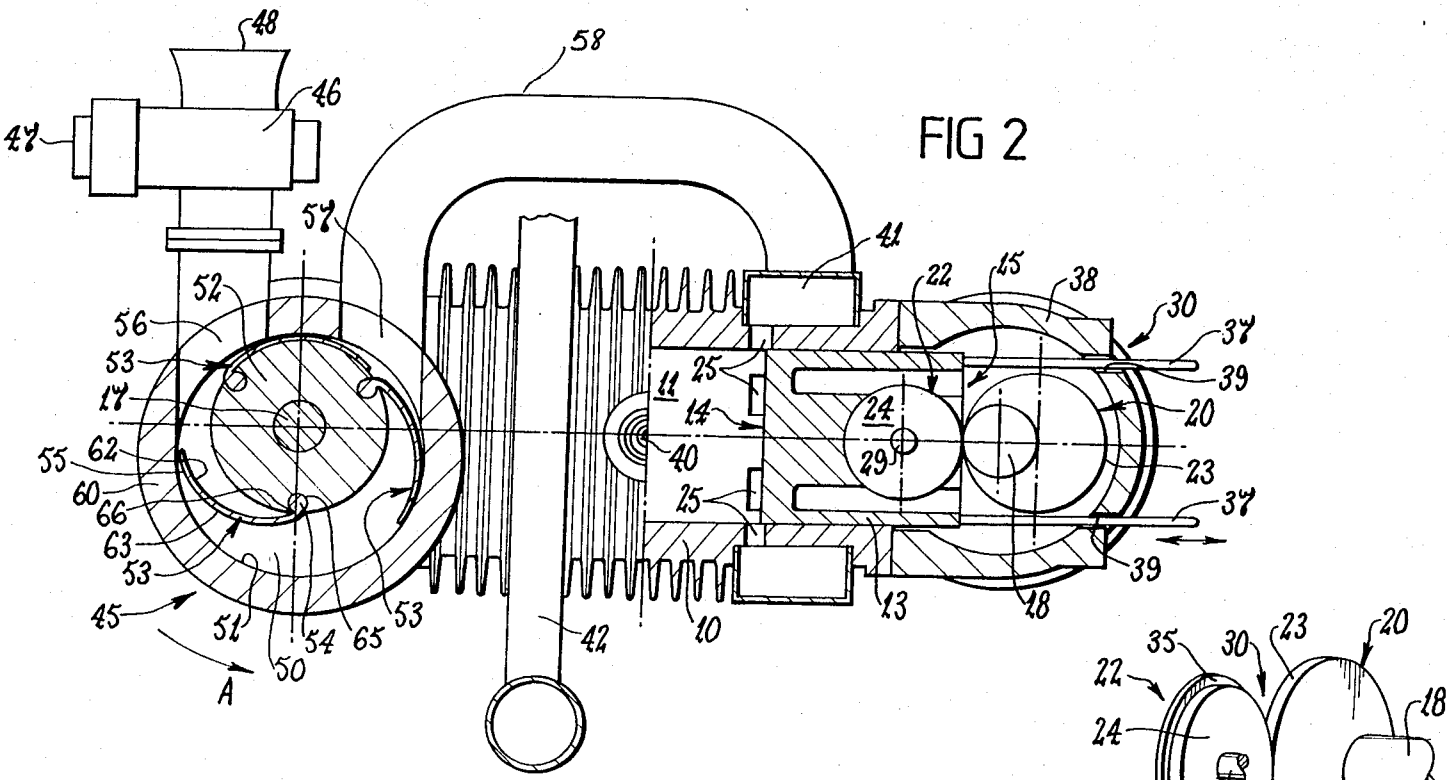
Figure 3:
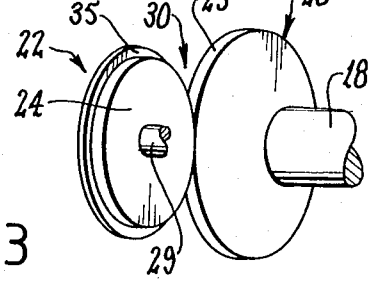

The present invention will now be described with particular reference to the accompanying drawings, in which:

FIG. 1 is a side sectional view of an internal combustion engine according a possible preferred embodiment, FIG. 2 is a part sectional side view of a second possible preferred embodiment having a different form of rotation prevention for the piston, and FIG. 3 is a perspective view of a third possible form of piston rotation preventing means.

Referring firstly to FIGS. 1 and 2, there is shown an internal combustion engine including: a cylinder 10, a combustion chamber 11 in the cylinder 10, and to opposed pistions 12,13 within the cylinder 10 and relatively movable towards and away from each other. The combustion chamber 11 is defined between the two pistons 12,13. Each piston 12,13 has an inner side 14 defining a movable wall of the combustion chamber 11 and also has an outer side 15. Two rotary output shafts 17,18 extend generally transverse to the axial direction of movement of the pistons 12,13. The pistons 12,13 are freely independently movable within the cylinder 10.

An eccentric portion, shown as a cam portion 20 is provided on each output shaft 17,18 so as to be rotatable therewith. Each piston 12,13 has an eccentric follower portion in the form of a cam follower portion 21, 22 on the outer side 15 thereof, each cam follower portion 21,22 bearing against the associated cam portion 20 of the respective output shaft 17,18 so as to transmit outwardly directed gas forces arising within the combustion chamber 11 and acting on the piston inner sides 14 to the cam portions 20 so as to drive the output shafts 17,18.

The configurations of the cam portions 20 and cam follower portions 21,22 are such that the gas forces acting on the inner sides 14 of the pistons 12,13 are sufficient to maintain contact between the cam follower portions 21,22 and the cam portions 20 for the major part of and preferably for substantially the entire operating cycle of the engine.

Maintaining the cam follower portions 21,22 in contact with the cam portions 20 for the major part of the operating cycle will result if the force of gas pressure on the inner sides 14 of the pistons 12,13 always exceeds the force of gas pressure on the outer sides 15 of the pistons 12,13. Preferably the configurations of the cam portions 20 and cam follower portions 21,22 are such that the momenta or inertial forces of the pistons imparted thereto by the cam portions 20 during movement of the pistons 12,13 towards each other are insufficient for the cam follower portions 21,22 to move out of contact with the cam portions 20 against the gas forces acting on the inner sides 14 of the pistions 12,13 when the pistons 12,13 are at or near their closest relative approach to each other so that the cam follower portions 21,22 remain in contact with the cam portions 20 for the entire operating cycle of the engine. That is, the gas forces acting on the inner sides 14 of the pistons 12,13 are sufficient to prevent separation of the cam follower portions 21,22 and cam portions 20 even during the final stages of the compression stroke and/or the early stages of the ignition or expansion stroke.

The cylinder 10 includes inlet ports 25 through which an air/fuel mixture is arranged to be admitted into the combustion chamber 11 and exhaust ports 26 through which the combustion products are arranged to be exhausted from the combustion chamber 11. During the operating cycle of the engine the fuel charge comprising the air/fuel mixture is arranged to be compressed during movement of the pistons 12,13 towards each other (compression stroke) and the compressed fuel charge is arranged to be ignited so as to drive the pistons 12,13 apart during a power or expansion stroke. The two pistons 12,13 are associated with respective output shafts 17,18 and the two output shafts 17,18 are coupled together so as to be rotatable in synchronism (in a manner not illustrated).

The output shafts 17,18 in the internal combustion engine according to the present invention takes the place of the crankshaft in a conventional internal combustion engine. The output shafts 17,18 extend at right angles to the axial direction of movement of the pistons 12,13. Each output shaft 17,18 may be provided with more than one cam portion 20 in the case of an engine having a plurality of cylinders 10 and associated pistons 12,13 arranged along the length of the output shafts 17,18. The cam portions 20 may be each defined by a profiled cam face such as the illustrated circular cam face 23 which is eccentrically located relative to the rotational axis of the output shaft 17,18.

Each cam follower portion 21,22 in FIGS. 1 to 3 comprises a rotary member 24 shown as a disc or roller which is rotatably mounted on the outer side 15 of the piston 12,13 so as to provide a rolling contact between the cam follower portion 21,22 and the cam portion 20, thereby reducing frictional energy losses and component wear. The rotary member 24 is rotatably mounted by a bearing arrangement including a bearing shaft 29 to which the rotary member 24 is concentrically mounted, the axis of the bearing shaft 29 being generally parallel to the associated output shaft 17,18, the bearing shaft 29 having its opposite ends rotatably mounted in bearings (not shown) provided on the outer side 15 of the respective piston 12,13.

Rotation preventing means 30 are provided associated with each piston 12,13 (represented in FIGS. 1 and 2 by piston 13) and operable to prevent rotation of the piston 13 within the cylinder 10 about the axis of movement of the piston 13. In the embodiment of FIG. 1, the rotation preventing means 30 comprises a projection 31 in the form of a peg or the like extending inwardly from the inner surface of the cylinder 11, the projection 31 being operatively associated with an axially extending groove 32 provided in the surface of the piston 13 which engages the inner surface of the cylinder 11. This arrangement is such that any tendency of the piston to rotate within the cylinder 11 about the axis of movement thereof as it reciprocates will be inhibited by the projection 31 being engaged by the walls of the axial groove 32.

In another possible embodiment shown in FIG. 3 the rotation preventing means 30 is provided by contouring of the rotary member 24 constituting the cam follower portion 22 and by providing complementary contouring of the cam portion 20 of the output shaft 18. For example, the rotary member 24 is shown in the form of a flanged disc or roller, the flange 35 extending radially from one side of the circumferential surface of the disc 24 which engages with the cam face 23, the flange 35 overlapping the edge of the circular or other profiled cam face 23 so that again any tendency of the piston 13 to rotate will be countered by the flange 35 engaging the side face of the cam wheel 20.

In FIG. 2, the rotation preventing means 30 comprises one or more rods 37 arranged parallel to but displaced from the axis of the cylinder 10. The rods 37 are associated with the outer side 15 of the piston 13 and with a housing 38 of the engine surrounding the output shaft 18 so as to prevent rotation of the piston 13 about the axis of the cylinder 10. In particular the rods 37 are fixed to the piston 13, and slidably engage in holes 39 in the housing 38. Obviously, alternatively the rods 37 may be fixed in the housing 38 and engage in holes in the outer side 15 of the piston 13.

Referring now to FIGS. 1 and 2, the two output shafts 17,18 are coupled together for synchronous rotation by providing pulley wheels or the like (not shown) at corresponding ends of the output shafts 17,18 around which a toothed belt or the like runs so that the output shafts 17,18 will rotate in synchronism. It will be appreciated that a chain and sprocket arrangement or an equivalent mechanism could be used as an alternative.

The engine is a two stroke engine so that each relative approach of the pistons 12,13 is a compression stroke and each relative separation constitutes an expansion or power stroke of the engine. The two pistons 12,13 are arranged to approach each other most closely at a central portion of the cylinder 10 at which position there is provided the spark plug 40 for igniting the compressed air/fuel mixture to initiate the expansion stroke.

The inlet ports 25 are provided at or towards one end of the cylinder 10 and the exhaust ports 26 at the opposite end of the cylinder 10. The inlet ports 25 and exhaust ports 26 (not shown in FIG. 2) may be opened and closed by means of associated valves which may be operated from a cam-shaft in generally conventional manner. However, in the preferred embodiment illustrated in FIG. 1 the inlet ports 25 and exhaust ports 26 are arranged to be opened and closed by the respective pistons 12,13. In FIG. 1, piston 13 opens inlet ports 25. The inlet ports 25 are comprised by simple apertures in the wall of the cylinder 10 arranged to be uncovered and thereby opened by the associated piston (12 in FIG. 1, 13 in FIG. 2) as it reaches its outermost extent of movement as shown. The outlet ports 26 are similarly comprised by simple apertures in the cylinder 10 arranged to be uncovered and thereby opened by the other piston (13 in FIG. 1) as it reaches its outermost extent of movement. The inlet ports 25 and outlet ports 26 are both open simultaneously whereby admission of the fuel charge under pressure through the inlet ports 25 forces at least part of the combustion products out through the exhaust ports 26.

The inlet ports 25 are in communication with an inlet manifold 41 extending around the outside of the cylinder 10. Similarly the exhaust ports 26 are in communication with an exhaust manifold 42 extending around at least part of the outside of the cylinder 10.

The engine illustrated also includes a feed blower 45 (FIG. 2) arranged to force the fuel-air mixture through the inlet ports 25 into the combustion chamber 11 under pressure. In the drawings the blower 45 receives an air/fuel mixture from mixing device 46 which receives fuel through inlet 47 and air through inlet 48. It will be appreciated that other arrangements are possible. For example blower 45 may be arranged to compress air to which fuel is added after the compression process. The introduction of the air/fuel mixture under pressure is desirable for rapidly introducing the air/fuel charge into the cylinder 10 and in the preferred arrangement of the engine illustrated, introduction of the air/fuel mixture into the cylinder 10 through inlet ports 25 under pressure forces at least part of the combustion products out of the exhaust ports.

The blower 45 is shown as a centrifugal pump driven by the output shaft 17 of the engine, through appropriate gearing (not shown) if necessary.

The centrifugal pump illustrated includes a pumping chamber 50 having internal chamber walls 51 and a driven rotor 52 eccentrically mounted within the pumping chamber 50. The blower 45 includes three pumping vanes 53, each having an inner edge 54 pivotally connected to the rotor 52 and an outer edge 55 operable to engage the pumping chamber walls 51 under centrifugal force during rotation of the rotor 52 and to pivotally retract towards the rotor 52.

The blower 45 includes an intake port 56 for receiving the air/fuel mixture, the intake port 56 being located in the pumping chamber wall 51 at an expansion side (left side in FIG. 2) where the outer edge 55 of each vane 53 moves outwardly away from the rotor 52 under centrifugal force. The blower 45 also includes an outlet port 57 located in the pumping chamber wall 51 at a compression side (right side of chamber 50 in FIG. 2) where the outer edge 55 of each vane 53 retracts inwardly towards the rotor 52 where the chamber side wall 51 approaches the eccentrically mounted rotor 52. The outlet port 57 is in communication through line 58 and inlet manifold 41 with the inlet ports 25 of the cylinder 10 to supply the air/fuel mixture under pressure to the engine.

The rotor 52 is driven in the direction of arrow A in FIG. 2 such that the outer edge 55 of each vane 53 trails behind the inner edge 54 thereof whereby any fluid back pressure transmitted through the outlet port 57 can be relieved between the vane outer edge 55 and the chamber walls 51 by pivoting of the vane 53 towards the rotor 52.

The blower 45 includes a housing 60 which defines the pumping chamber 50. The pumping chamber 50 may be substantially cylindrical having a pair of opposed end walls (not shown), one of which may be defined by a removable cover plate enabling access to the chamber 50 for assembly and maintenance purposes. The associated output shaft 17 may extend through the other end wall.

Preferably the outlet port 57 is located so that the fluid does not expand when entering the outlet port 57 since this would be wasteful of the work input to the rotor 52.

The vanes 53 are preferably generally rectangular. As can be seen in FIG. 2, each vane 53 is curved across its radial width to provide opposite concave and convex broad surfaces 62,63, the concave surface 62 facing towards the rotor 52 and being generally complementary to the outer surface of the rotor 52 so that the vane 53 can pivot to a fully retracted position with the concave surface 62 closely overlying the rotor outer surface—see uppermost vane in FIG. 2. With rotation in the direction of arrow A, fluid (air, fuel or the air/fuel mixture) is compressed in front of the convex vane surfaces 63 and fluid is drawn into the pumping chamber 50 from behind the concave vane surfaces 62 as the vanes 53 sweep past the inlet port 56.

The three vanes 53 have radial widths such that the vanes 53 substantially cover the entire rotor curved surface or circumference if all the vanes 53 are fully retracted onto the rotor 52. That is, with the three vanes 53 provided, each has a concave surface radius of curvature the same as the radius of the outer surface of the rotor 52 and each vane width is approximately equal to one third of the circumference of the rotor 52.

Each vane 53 is provided with an enlarged pivoting head at its inner edge 54, the rotor 52 being provided with a complementary groove 65 having a restricted opening 66 in the radially outer portion of the groove 65, the pivoting head being received within the groove 65 and the restricted opening 66 preventing radial removal of the pivoting head from the groove 65. The pivoting heads extend along the inner edges 54 and the grooves 65 are parallel to the axis of rotation of the rotor 52. Each vane 53 can be assembled with the rotor 52 by sliding the pivoting head into the complementary groove from one end of the cylindrical rotor 52.

The pumping vanes 53 may be made of any suitable material. Preferably a rigid wear-resistant material such as metal is used.

It will be seen that excessive back-pressure in the outlet 57 will not damage the pump described since the vanes 53 can pivot towards the rotor 52 in response to any excessive back-pressure to allow pressure relief between the outer edges 55 of the vanes 53 and the chamber side walls 51. Thus backfiring in the internal combustion engine will not damage this type of pump.

In operation of the opposed piston engine having the drive arrangement between the pistons 12,13 and the output shafts 17,18 constructed according to the present invention, starting with the pistons 12,13 at their closest approach, the air/fuel charge will have been compressed between the pistons 12,13 as they moved together and the charge will now be ignited by the spark plug 40 thus driving the pistons 12,13 apart. The outward gas forces acting on the inner sides 14 of of the pistons 12,13 will be transmitted by the cam follower portions 22 on the outer sides 15 of the pistons 12,13 to the cams 23 provided on the respective output shafts 17,18, thus transmitting drive to the output shafts 17,18. As the pistons 12,13 move towards their greatest separation, the outlet ports 26 are uncovered first and the combustion products begin to discharge into the atmosphere under the residual pressure in the cylinder 10. With further separation of the pistons 12,13 the inlet ports 25 are uncovered and a fresh charge of air/fuel mixture begins entering the cylinder 10 under pressure from the blower 45. The induction of the fresh charge will continue as the pistons 12,13 reach their greatest separation and until the inlet ports 25 are closed as the pistons 12,13 are moving towards each other. The induction of the fresh charge into the cylinder 10 also serves to purge combustion products from the cylinder 10 whilst the exhaust ports 26 remain uncovered. At the furthest separation of the two pistons 12,13, the inlet and exhaust ports 25,26 will be open to their fullest extent. Continued rotation of the output shafts 17,18 will cause the cams 23 to drive the pistons 12,13 toward each other, the cams 23 acting through the cam followers 22 provided on the outer sides 15 of the pistons 12,13. During this compression part of the cycle the gas forces exerted by the air/fuel charge being compressed and acting outwardly on the pistons 12,13 will maintain the cam followers 22 in contact with the respective cams 23 even against the momenta or inertial forces of the approaching pistons 12,13 which would tend to carry the cam followers 22 out of contact with the cams 23 towards the end of the compression stroke.

The drive arrangement between the pistons 12,13 and the output shafts 17,18 in the engine according to the present invention is particularly suited for a small lightweight positively scavenged two-stroke engine such as described above. In this case, the gas pressures on the outer sides 15 of the two opposed pistons 12,13 are close to ambient and those on the inner sides 14 of the pistons 12,13 are always above ambient. The replacement of the conventional crankshaft with output shafts 17,18 having one or more circular or other profiled cams 23 and the replacement of the conventional connecting rods with rotary cam followers 24 enables the engine according to the present invention to be readily manufactured and the size and hence the weight of the engine for a given swept volume can be reduced. The advantageous effect on engine size is particularly apparent with the opposed piston positively scavenged two-stroke engine described above.

We claim:

1. An internal combustion engine having an operating cycle and including: a cylinder, a combustion chamber in the cylinder, two opposed pistons within the cylinder and relatively movable towards and away from each other, the combustion chamber being defined between the two pistons, each piston having an inner side defining a movable wall of the combustion chamber and also having an outer side, two rotary output shafts extending generally transverse to the axial direction of movement of the pistons, characterised in that said pistons are freely independently movable within the cylinder, an eccentric portion being provided on each output shaft so as to be rotatable therewith which comprises a cam face which is eccentrically located relative to the rotational axis of the respective output shaft, each piston having an eccentric follower portion on the outer side thereof which comprises a rotary member which is rotatably mounted on the outer side of each piston so as to provide a rolling contact between the eccentric follower portion and the eccentric portion, each eccentric follower portion being arranged to bear against the associated eccentric portion of the respective output shaft solely under inertial forces and gas forces that are outwardly directed and arise within the combustion chamber with the eccentric portion being unconstrained by said eccentric follower portion so as to transmit outwardly directed gas forces arising within the combustion chamber and acting on the piston inner sides to the eccentric portions so as to drive the output shafts.

2. An internal combustion engine as claimed in claim 1 characterised in that the rotary member is rotatably mounted by a bearing arrangement including a bearing shaft to which the rotary member is concentrically mounted, the axis of the bearing shaft being generally parallel to the associated output shaft, the bearing shaft having opposite ends rotatably mounted in bearings provided on the outer side of the respective piston.

3. An internal combustion engine as claimed in claim 1 characterised in that the eccentric and eccentric follower portions are configured such that the gas forces acting on the inner sides of the pistons are sufficient to maintain contact between the eccentric follower portions and the eccentric portions for a major part of the operating cycle of the engine.

4. An internal combustion engine as claimed in claim 3 characterised in that the eccentric and eccentric follower portions are configured such that momentum of the pistons imparted thereto by the eccentric portions during movement of the pistons towards each other are insufficient for the eccentric follower portions to move out of contact with the eccentric portions against the gas forces acting on the inner sides of the pistons when the pistons are near their closest relative approach to each other so that the eccentric follower portions remain in contact with the eccentric portions for the entire operating cycle of the engine.

5. An internal combustion engine as claimed in claim 1 and further characterised by rotation preventing means associated with each piston and operable to prevent rotation of the piston within the cylinder about the axis of movement of the piston.

6. An internal combustion engine as claimed in claim 5 characterised in that the rotation preventing means comprises a projection extending inwardly from the inner surface of the cylinder, the projection being operatively associated with an axially extending groove provided in the surface of the piston which engages the inner surface of the cylinder, the arrangement being such that any tendency of the piston to rotate within the cylinder about the axis of movement thereof as it reciprocates will be inhibited by the projection being engaged by the walls of the axial groove.

7. An internal combustion engine as claimed in claim 5 characterised in that the rotation preventing means is comprised by contouring of the rotary member and by complementary contouring of the eccentric portion of the output shaft.

8. An internal combustion engine as claimed in claim 5 characterised in that the rotation preventing means comprises at least one rod arranged parallel to but displaced from the axis of the cylinder, said at least one rod being associated with the outer side of the piston and with a housing of the engine surrounding the output shaft so as to prevent rotation of the piston about the axis of the cylinder.

9. An internal combustion engine as claimed in claim 1, the engine being further characterised by:

an inlet port in the cylinder for admitting a fuel-air mixture to the combustion chamber, and an exhaust port in the cylinder for exhausting combustion products from the combustion chamber, the two pistons being movable towards each other within the cylinder during a compression stroke to compress the fuel charge and being movable away from each other during an expansion stroke upon ignition of the compressed charge a feed blower being arranged to force the fuel-air mixture through the inlet port into the combustion chamber under pressure, the feed blower including:

a pumping chamber having internal chamber walls, a driven rotor eccentrically mounted within the pumping chamber, at least one pumping vane having an inner edge pivotally connected to the rotor and an outer edge operable to engage the pumping chamber walls under centrifugal force during rotation of the rotor and to pivotally retract towards the rotor, an intake port for receiving a fluid used in the fuel charge, the intake port being located in the pumping chamber wall at an expansion side thereof where the outer edge of said at least one vane moves outwardly away from the rotor under centrifugal force, an outlet port located in the pumping chamber wall at a compression side thereof where the outer edge of said at least one vane retracts inwardly towards the rotor where the chamber side wall approaches the eccentrically mounted rotor, the outlet port being in communication with the inlet port of the cylinder to supply the fluid under pressure to the engine.

10. An internal combustion engine as claimed in claim 9 characterised in that said at least one vane is provided with an enlarged pivoting head at its inner edge, the rotor being provided with a complementary groove having a restricted opening in the radially outer portion of the groove, the pivoting head being received within the groove and the restricted opening preventing radial removal of the pivoting head from the groove.

11. An internal combustion engine as claimed in claim 9 characterised in that output shafts are coupled together for synchronous rotation.

12. An internal combustion engine as claimed in claim 9 characterised in that the inlet port is comprised by an aperture in the cylinder arranged to be uncovered and thereby opened by one of the pistons as it reaches its outermost extent of movement, the outlet port being comprised by an aperture in the cylinder arranged to be uncovered and thereby opened by the other of the pistons as it reaches its outermost extent of movement, the inlet and outlet ports being both open simultaneously whereby admission of the fuel charge under pressure through the inlet port forces at least part of the combustion products out through the exhaust port.

13. An internal combustion engine as claimed in claim 9 characterised in that the rotor is driven in a direction such that the outer edge of said at least one vane trails behind the inner edge thereof whereby any fluid back pressure transmitted through the outlet port can be relieved between the vane outer edge and the chamber walls by pivoting of the vane towards the rotor.

14. An internal combustion engine as claimed in claim 13 characterised in that said at least one vane is curved across its radial width to provide opposite concave and convex surfaces, the concave surface facing towards the rotor and being generally complementary to the other surface of the rotor so that the vane can pivot to a fully retracted position with the concave surface closely overlying the rotor outer surface.

15. An internal combustion engine as claimed in claim 14 characterised in that a plurality of pumping vanes are provided, each vane being pivotally connected to the rotor and arranged so that the vanes when fully retracted cover substantially the entire circumference of the rotor.

* * * * *

UNITED STATES PATENT AND TRADEMARK OFFICE

CERTIFICATE OF CORRECTION

PATENT NO. : 4,526,141

DATED : July 2, 1985

INVENTOR(S) : Ben PARMINGTON et al

It is certified that error appears in the above-identified patent and that said Letters Patent is hereby corrected as shown below:

Under [75] Inventor information should read as follows:

-- Inventors: Ben Parmington, Lower Templestowe, Australia; Brian G. Catchpole, Burwood, Australia --

Title page, Item [19] should read --Parmington et al--.

Signed and Sealed this

*Fifth* Day of *November 1985*

[SEAL]

*Attest:*

DONALD J. QUIGG

*Attesting Officer*

*Commissioner of Patents and Trademarks*